US010492578B2

(12) United States Patent
Heim et al.

(10) Patent No.: US 10,492,578 B2
(45) Date of Patent: Dec. 3, 2019

(54) CROSS-COUNTRY SKI POLE HANDLE

(71) Applicant: LEKISPORT AG, Baar (CH)

(72) Inventors: Eberhard Heim, Unterensingen (DE); Marco Hofer, Deggingen (DE)

(73) Assignee: LEKISPORT AG, Baar (CH)

( * ) Notice: Subject to any disclaimer, the term of this patent is extended or adjusted under 35 U.S.C. 154(b) by 197 days.

(21) Appl. No.: 15/525,112

(22) PCT Filed: Oct. 15, 2015

(86) PCT No.: PCT/EP2015/073847
§ 371 (c)(1),
(2) Date: May 8, 2017

(87) PCT Pub. No.: WO2016/071090
PCT Pub. Date: May 12, 2016

(65) Prior Publication Data

US 2018/0271236 A1 Sep. 27, 2018

(30) Foreign Application Priority Data

Nov. 7, 2014 (CH) ..... 1732/14

(51) Int. Cl.
*A45B 9/02* (2006.01)
*A63C 11/22* (2006.01)

(52) U.S. Cl.
CPC ..... *A45B 9/02* (2013.01); *A63C 11/222* (2013.01); *A45B 2009/025* (2013.01)

(58) Field of Classification Search
CPC .... A63C 11/222; A45B 2009/025; A45B 9/02
See application file for complete search history.

(56) References Cited

U.S. PATENT DOCUMENTS 5,110,154 A * 5/1992 Street ..... A41D 19/0037 135/72
5,312,134 A * 5/1994 Goode ..... A41D 19/0037 2/160

(Continued)

FOREIGN PATENT DOCUMENTS

FR 2668377 A1 * 4/1992 ..... A63C 11/222
WO 2006/066423 A1 6/2006

OTHER PUBLICATIONS

International Preliminary Report on Patentability dated May 18, 2017 in counterpart International application No. PCT/EP2015/073847.

*Primary Examiner* — Victor D Batson
*Assistant Examiner* — Matthew J Sullivan
(74) *Attorney, Agent, or Firm* — Sughrue Mion, PLLC

(57) ABSTRACT

The invention relates to a pole handle (1), in particular for trekking poles, Nordic walking poles, Alpine ski poles, or cross-country ski poles, comprising a handle head (2), a handle body (3), and a hook-like device (4) for securing a handling device. A movable, pivotal, or rotatable latching means (5) is arranged in the region of the hook-like device such that a loop-, ring-, or eye-shaped device, which is provided on the handling device and inserted into the hook-like device substantially from above, is fixed in the hook-like device in a self-latching manner. The latching means is designed in the form of a retaining lug which defines a constrained region (7) for the loop-, ring-, or eye-shaped device towards the bottom in the braced position. Additionally, a recess (8) is provided in the handle head and/or handle body from above, wherein a movably and/or rotatably mounted securing block (9) on or in which the engaging means is arranged is arranged in the recess.

22 Claims, 5 Drawing Sheets

(56) References Cited

U.S. PATENT DOCUMENTS

| | | | | |
|---|---|---|---|---|
| 5,470,108 | A * | 11/1995 | Goode | A63C 11/222 135/75 |
| 5,516,150 | A * | 5/1996 | Goode | A41D 19/0037 2/161.1 |
| 6,325,418 | B1 * | 12/2001 | Lenhart | A63C 11/222 280/821 |
| 7,891,708 | B2 * | 2/2011 | Panizza | A63C 11/222 135/72 |
| 8,123,252 | B2 * | 2/2012 | Lenhart | A45B 9/02 16/436 |
| 8,579,329 | B2 * | 11/2013 | Lenhart | A63C 11/222 280/821 |
| 8,678,020 | B2 * | 3/2014 | Renaud-Goud | A45B 9/02 135/65 |
| 8,714,172 | B2 * | 5/2014 | Heim | A45B 9/02 135/72 |
| 8,850,670 | B2 * | 10/2014 | Fiedler | A44B 11/2592 24/303 |
| 9,027,206 | B2 * | 5/2015 | Guyoton | A63C 11/222 16/114.1 |
| 9,168,448 | B2 * | 10/2015 | Donnadieu | A45B 9/02 |
| 9,526,974 | B2 * | 12/2016 | Bennert | A63C 11/228 |
| 9,867,436 | B2 * | 1/2018 | Lenhart | A45B 9/02 |
| 10,064,463 | B2 * | 9/2018 | Kreis | A45B 9/02 |
| 2006/0143867 | A1 * | 7/2006 | Wu | A63C 11/222 16/436 |
| 2007/0120353 | A1 * | 5/2007 | Panizza | A63C 11/222 280/821 |
| 2010/0218347 | A1 | 9/2010 | Lenhart | |

* cited by examiner

CROSS-COUNTRY SKI POLE HANDLE

CROSS REFERENCE TO RELATED APPLICATIONS

This application is a National Stage of International Application No. PCT/EP2015/073847, filed on Oct. 15, 2015, which claims priority from German Patent Application No. 01732/14, filed on Nov. 7, 2014, the contents of all of which are incorporated herein by reference in their entirety.

TECHNICAL SCOPE

The present invention relates to a pole handle, in particular for walking poles, trekking poles, Alpine ski poles, cross-country ski poles or Nordic walking poles, having a handle body with a hook-like device for fastening a hand-retaining device, in particular in the form of a hand strap or a glove. In this case, latching means are arranged in the region of the hook-like device in such a manner that a strap-shaped, ring-shaped or eyelet-shaped device, which is inserted from above into the hook-like device and is provided on the hand-retaining device, is fixed in a self-locking manner in the hook-like device.

PRIOR ART

WO 2006/066423 A1 discloses a pole handle having a holding mandrel for fastening a hand-retaining device. In the case of said pole handle, in particular for walking poles, trekking poles, Alpine ski poles, cross-country poles and Nordic walking poles, there is a handle body and a hook-like device for fastening a hand-retaining device in particular in the form of a hand strap or a glove. Displaceable or rotatable latching means are arranged in the region of the hook-like device in such a manner that a strap-shaped, ring-shaped or eyelet-shaped device, which is inserted substantially from above into the hook-like device and is provided on the hand-retaining device, is fixed in a self-locking manner in the hook-like device. With all the advantages, the design described therein has the disadvantage, among others, that dirt or snow, e.g. in the event of a fall, is able to penetrate into the slot formed in the pole handle by the hook-like device or into gaps between the release button and the wall of the recess of the handle in which the release button is accommodated. This can, in particular at temperatures below freezing, result in the latching mechanism being blocked, e.g. as a result of ice formation, or rather in the eyelet-shaped device not being able to be latched-in or no longer being able to be released, the latter possibly being a safety risk in the event of a fall. In addition, the latching mechanism of the embodiment of the document described in conjunction with FIGS. 4 and 5 is above all only releasable as a result of actuating the actuating button by means of the other hand or, in the case of particularly skilled handling, by means of the index finger, on account of the asymmetric realization of the handle head, but not in a convenient manner, e.g. by means of the thumb.

REPRESENTATION OF THE INVENTION

It is an object of the present invention to provide a pole handle for cross-country athletes, in particular, among others, biathlon athletes, which overcomes the disadvantages of the prior art.

Said object is achieved by a pole handle according to claim 1.

The pole handle according to the invention is suitable, in particular, for trekking poles, Nordic walking poles, Alpine ski poles or cross-country poles. It comprises a handle head and a handle body, as well as a hook-like device for fastening a hand-retaining device, in particular in the form of a hand strap or a glove.

At least one displaceable, pivotable or rotatable latching means is arranged in the region of the hook-like device in such a manner that a strap-shaped, ring-shaped or eyelet-shaped device, which is inserted substantially from above into the hook-like device and is provided on the hand-retaining device, is fixed in a self-locking manner in the hook-like device.

In this case, the hook-like device is arranged on the pole handle on the hand side in the top region of the handle body or in the handle head. The hook-like device includes a holding mandrel or holding pin which is arranged offset to the hand side from the handle body thereby realizing an insertion slot or as an incision in the handle body. The holding mandrel or holding pin can be arranged substantially parallel to the pole handle longitudinal axis, but it can also be inclined rearward to a certain extent, that is to say toward the rear side or hand side, by an angle $\beta$ in a plane spanned by the pole axis and the direction of movement such that it is not accessible from above parallel to the pole handle longitudinal axis, but from a slight upward angle. The corresponding opening angle $\beta$ (to be understood with a positive sign anticlockwise in FIG. 1*b*) is consequently preferably within the range of between 0 and 15°, in particular in a preferred manner within the range of between 5 and 12°, wherein 0° actually means parallel to the pole handle longitudinal axis. Such a slight inclination of the holding mandrel or holding pin, i.e. when $\beta>0°$, results, among other things, in better introduction of force when utilizing the pole with restricted strap/eyelet. The hook-like device is preferably integrally formed on the handle body. The holding mandrel or holding pin, when viewed in cross section with respect to its axis of extension, can comprise a circular cross section, but can also comprise an oval cross section. A particularly preferred embodiment of the holding mandrel or rather holding pin is characterized in that the cross section is to a certain extent D-shaped, the flattened region pointing in the hand direction. If such an embodiment of the holding mandrel or rather holding pin is used combined with a strap/eyelet, which is correspondingly realized in a D-shaped manner or is fastened on the hand-retaining device such that a corresponding rigid flattened zone directly faces the hand, an anti-rotation device for the hand strap in relation to the holding mandrel/holding pin is produced as a result by the abutment of the two flattened regions of strap/eyelet against the holding mandrel/holding pin. In an advantageous manner, the depth of the insertion slot is greater than the width and the thickness of the holding mandrel or holding pin. According to a preferred embodiment, the hook-like device comprises a width within the range of between 3 and 15 mm, preferably within the range of between 4 and 10 mm, the hook-like device in a particularly preferred manner comprising at least in portions a substantially oval or rectangular cross section perpendicular to the pole handle axis, where applicable with rounded edges. The insertion slot typically has a depth (to be understood as the length of the slot substantially parallel or slightly inclined to the longitudinal axis of the pole) within the range of between 5 and 50 mm, in a preferred manner within the range of between 10 and 30 mm.

The latching means is realized in the form of a retaining lug or latching lug which, in the braced position, defines in the downward direction a restricted or enclosed region for the strap-shaped, ring-shaped or eyelet-shaped device. To this end, a recess is provided from above in the handle head and/or handle body, in which recess a displaceably and/or rotatably mounted locking block is arranged, on or in which the latching means is arranged. The core of the invention is that, on its upper side, the locking block comprises an actuating region which forms the handle head at least in part and which, on the hand side, in a rear handle head region, engages over the top of the insertion slot at least in part without closing the access to the insertion slot.

In other words, the actuating region overlaps the insertion slot, but leaves it accessible, however, from a hand side or rather from the rear or at an angle from above so that the strap-shaped, ring-shaped or eyelet-shaped device of the hand-retaining device can be pulled over or rather guided over the holding mandrel. Consequently, the insertion slot is accessible from the outside both in the rest position, in which the retaining lug is braced against the holding mandrel, and in a release position in which, as a result of the movement of the actuating region, the retaining lug is removed out of the insertion slot.

According to a preferred embodiment, the actuating region forms a top closure of the handle head, wherein the actuating region preferably engages over the top of a side wall, in a preferred manner of both lateral side walls of the handle head. In order to prevent an ingress of water, dirt or snow through said slot between actuating region and respective side wall, the lower edge of the actuating region can be realized correspondingly, for example in a stepped manner, and the side wall adjoining there can be correspondingly stepped, or it is also possible to realize a labyrinth edge in said region. As the actuating region and the side wall are realized here with the same radius about the pivot point of the block, good seals can be achieved with small tolerances. In an advantageous manner, the actuating region additionally covers a downwardly beveled flank of the handle head in a front handle head region.

In a particularly preferred embodiment, the actuating region, in a rear handle head region, on the hand side or rather directed rearward, comprises an extension which preferably extends substantially transversely to the pole handle longitudinal axis along a horizontal direction (opposite to the direction of movement of the user) and which overlaps the insertion slot at least in part. Consequently, the insertion slot is overlapped at least in part by the extension of the actuating region both in a rest position, in which the latching means is braced against the hook-like device, and in a release position in which the latching means releases the insertion slot at least in part.

It is particularly advantageous when the extension comprises on its hand-side end an upwardly beveled flank which extends upward forming an angle of between 95 and 120 degrees, preferably of between 100 and 105 degrees, to a plane which is spanned by the pole handle longitudinal axis and the rotational axis. As a result, more space remains on the holding mandrel for the coupling of the hand-retaining device or rather the insertion of the strap-shaped, ring-shaped or eyelet-shaped device.

The activating region at its widest point preferably comprises a width of between 0.7 and 2.5 cm, in particular preferably of approximately between 1 and 2 cm. The actuating region at its widest point preferably comprises an almost identically large or preferably an at least identically large, or preferably a somewhat larger width, i.e. by a total of between 1 and 5 mm, than a width of the handle head at its widest point. The actuating region consequently "caps" the handle head to a certain extent. In contrast to various embodiments from the prior art, the actuating region here is not embedded in the handle head. The advantage of this is that no dirt or snow is able to penetrate into the handle head recess between the actuating region and the side wall of the handle head.

In addition, it is advantageous when the actuating region extends further in the front handle head region in the direction of movement than the handle head in the front handle head region. Here too, an overlap results in the ingress of the dirt or snow into the handle head recess being avoided.

According to a further preferred embodiment, the locking block is mounted on the handle head so as to be rotatable about a horizontal rotational axis which is arranged perpendicularly to the pole handle longitudinal axis and preferably transversely to the direction of movement. This is preferably realized by a transverse pin, by means of which the locking block is mounted in the handle head, and which projects through the locking block and the side walls of the handle head.

A bottom edge of the actuating region, which adjoins a side wall of the handle head, and preferably also the two side walls of the handle head at that location, preferably forms at least in regions an arc about the rotational axis of the locking block. In this case, a circle with a circle radius of between 0.5 and 3.5 cm, preferably within the range of between 0.5 and 1.5 cm, is preferably defined.

The locking block can be realized in one piece with the actuating region or can be integrally formed on the locking block. Consequently, in said embodiment, to a certain extent the actuating region forms the topmost portion of the locking block. The actuating region, in this case, can be realized from a softer material than the locking block, for example with more grip-friendly characteristics.

When the pole handle is looked at from the side, or rather in relation to or relative to a plane which is spanned by the pole handle longitudinal axis and the direction of movement, the actuating region is preferably realized in a convex manner or rather is curved downward or in an arched manner. The actuating region is preferably realized in a downwardly directed arched manner at least in the front handle head region, also in the hand-side rear handle head region. This allows the handle head to be comfortably gripped around from above, for example when supporting. This allows the locking block/actuating region to be actuated in many ways, namely with the thumb, with the index finger, of the same or the other hand.

According to a particularly preferred embodiment, in addition to this or as an alternative to it, the actuating region is realized in a convex manner or rather is curved downward or in an arched manner in relation to or rather relative to a plane which extends perpendicularly to the pole handle longitudinal axis.

A particularly grip-friendly embodiment comprises an actuating region which, on its top surface, comprises a structuring, in particular a ribbing, which is suitable for avoiding a user finger slipping. The structuring, in this case, is preferably arranged both in a rear or rather hand-side handle head region and in a front handle head region of the actuating region.

For the purpose of ergonomic shape and saving material, a further preferred embodiment is characterized in that the actuating region is realized in a converging manner in the direction of movement in the front handle head region and/or in the hand-side rear handle head region when viewed from above.

A further preferred embodiment is characterized in that, in the front handle head region, the actuating region additionally comprises an extension which overlaps the handle head in the direction of movement, preferably by between 1 and 3.5 cm, preferably within the range of between 1.5 and 2.8 cm. Said embodiment is particularly suitable, for example, for use in biathlon. When the athlete takes up the pole in a loose manner, the pole handle can slip through the hand of the athlete and come to a stop in the ready position at the lower edge of said extension which serves to a certain extent as a "stop catch". In the stop position, the hand strap of the athlete is then arranged at the correct height of the pole handle so that the athlete is then able, almost "blindly", to click the hand-retaining device into the handle or rather on the holding mandrel by means of the strap-shaped, ring-shaped or eyelet-shaped coupling element.

Said function is particularly favored in a pole handle, the actuating region of which comprises, in a front handle head region, a substantially straight portion which extends on the top surface in the direction of movement substantially horizontally to the pole handle longitudinal axis, preferably over a length of between 1.0 and 3.5 cm, preferably over a length of between 1.5 and 3.5 cm, in particular preferably between 2 and 3 cm. To this end, it is particularly advantageous when, in the front handle head region, the actuating region comprises an end which connects to the straight portion and is bent downward. The downwardly directed curvature on the bottom surface or rather bottom edge of the extension in the front handle head region which overlaps the handle head preferably describes at least in part an arc of a circle which has substantially at least the same arc radius as a finger, in particular an index finger, of a user. The end is then bent off in such a manner that the end describes a somewhat larger curvature or rather a smaller arc radius such that the extension can serve in an optimum manner as a stop catch. The extension can additionally have at least one material cutout or rather recess or indentation for the purpose of saving material and consequently weight.

The above-described latching means is preferably realized in the form of a retaining lug or rather latching lug which is preferably arranged on or in the locking block or is realized in one piece with the locking block. The retaining lug can, for example, form the bottom portion of the locking block.

Said retaining lug, in this case, in a position braced against the hook-like device (rest position of the latching mechanism when the pole is in use), defines downward a restricted region for the strap-shaped, ring-shaped or eyelet-shaped device. The strap-shaped, ring-shaped or eyelet-shaped device is consequently held captive in said restricted region, until it is released by means of releasing the latching mechanism as a result of rotating/tilting the actuating region in a direction to a hand side of the user or rather rearward (opposite the direction of movement).

The locking block is advantageously braced by means of a spring, in particular in a preferred manner by means of a leaf spring, against the hook-like device which is arranged on the hand side. In this case, the spring is preferably arranged in a recess of the locking block, wherein the recess is preferably arranged in a front region of the locking block, said front region being directed away from the hook-like device in the direction of movement. In said preferred embodiment, the spring is braced there against a (front) inside wall of the handle head in the recess of the handle head. This allows for a self-locking mechanism. For this purpose, the retaining lug preferably comprises a beveled flank parallel to the pole handle longitudinal axis from top to bottom in the direction of insertion. To achieve the self-locking, the user has just to guide the strap-shaped, ring-shaped or eyelet-shaped device on the hand-retaining device in the rest position over the holding mandrel, the retaining lug being displaced out of the insertion slot against the spring force and snapping back as soon as the strap-shaped, ring-shaped or eyelet-shaped device is caught in the restricted region.

According to a particularly preferred embodiment, the locking block is tiltable against the force of the spring about the rotational axis from outside by means of the actuating region thereby releasing the self-locking. For this purpose, the actuating region is tilted toward one hand side of the user. This can be achieved in a convenient manner by means of the index finger or by means of the thumb of the hand. In the case of the above-described variant for biathlon sport with the extension on the front handle head region, the actuating region can be additionally actuated or rather pivoted as a result of moving the index finger held under the stop catch axially upward along the pole handle longitudinal axis.

The pole handle can additionally have a mechanism for automatic release, for example as a safety aspect. Such an automatic release can be realized by a separate mechanism, such as is disclosed, for example, in WO 2006/066423, however it can also be achieved simply as a result of the bottom region of the retaining lug being realized in a beveled manner, namely angled slightly upward toward the holding mandrel such that the block is able to be deflected when there is a sufficiently large tensile force upward on the strap/eyelet against the restoring force of the spring 12.

The present invention additionally relates to a pole, in particular a walking pole, trekking pole, Alpine ski pole, cross-country ski pole or Nordic walking pole having a pole handle according to one of the previously described embodiments.

Further exemplary embodiments are described in the dependent claims.

BRIEF DESCRIPTION OF THE DRAWINGS

Preferred embodiments of the invention are described below by way of the drawings which simply serve for explanation and are not to be interpreted as restricting. The drawings are as follows.

DESCRIPTION OF PREFERRED EMBODIMENTS

Figure 1A:
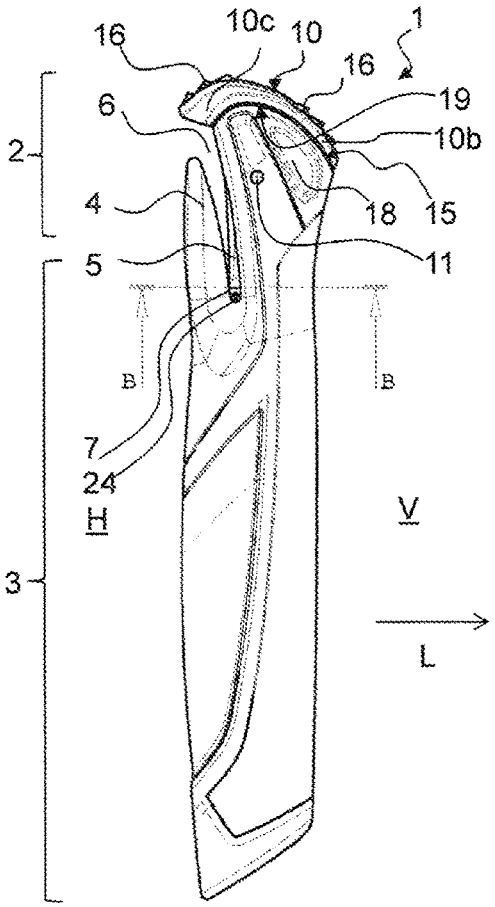
FIG. 1 shows a schematic representation of a side view of a pole handle according to a first preferred embodiment, FIG. 1*a* showing the pole handle in a rest position (or rather in a position braced against the hook-like device) and FIG. 1*b* showing the pole handle in a release position.

FIGS. 1*a*-7*b* show a pole handle according to a first preferred embodiment of the invention. This is suitable, in particular, for the sport of cross-country or Nordic walking. In this case, the hand side H is the rear side of the pole handle, from which the user engages the pole handle 1 and from which the hand-retaining device is coupled to the pole handle 1. The direction of movement L is directed forward V when viewed by the user. The pole handle 1 shown, which is suitable for receiving a pole tube, comprises a handle body 3 and a handle head 2 which connects to the top of the handle body. For accommodating the pole tube, the pole handle 1 comprises an insertion opening 20, which can be seen in FIG. 4, and a recess 21, or rather a cavity or a blind hole, which can be seen in FIGS. 6*a*, 6*b*. The handle head 2 comprises a hand-side or rather rear handle head region 2*a* which extends in a direction R opposite a direction of movement L, and comprises a front handle head region 2*b* which is aligned in the direction of movement L when the pole is in use. The handle head 2 is realized in its front handle head region 2*b* with a downwardly beveled flank 15. A recess 8, which is provided for receiving a locking block 9, is arranged from above in the handle head 2. Said recess 8 is delimited downward, that is to say is realized to a certain extent as a blind hole. The locking block 9 is mounted in said recess 8 in the handle head 2 so as to be rotatable or rather tiltable or pivotable about a rotational axis 11, which is arranged perpendicularly to the pole handle longitudinal axis S. The rotational axis 11 is realized by a transverse pin which projects through the side walls 18 of the handle head 2 and the locking block 9. The tilting of the locking block 9 is achieved as a result of actuating an actuating region 10 in the direction of rotation D toward the hand side H. Said actuating region 10 forms the top surface or rather the top closure of the handle head 2, or rather covers the side walls 18 and the beveled flank 15 of the handle head 2. In addition, the actuating region 10 comprises a greater thickness d in the rear handle head region 2*a* than in the front handle head region 2*b*. In the present exemplary example, the actuating region 10 overlaps the side walls 18 of the handle head 2 in a direction transversely to the pole handle longitudinal axis S. This means that the actuating region 10 comprises a greater width at its widest point b1 than the width of the handle head 2 at its widest point below the actuating region 10 or rather than the maximum spacing between the two side walls 18 of the handle head 2 which come to rest under the actuating region 10. The actuating region 10, in this case, comprises its widest point b1 for instance in a region which is located above the rotational axis 11 on the handle head top surface when viewed along the pole handle longitudinal axis S. This can be seen, in particular, in FIGS. 4, 7*a* and 7*b*. In addition, the actuating region 10 is shown in a converging manner in the front handle head region 2*b* and in the rear handle head region 2*a*.

When seen from the side, that is to say in a plane E1 which is spanned by the direction of movement L and the pole longitudinal axis S, the actuating region 10 comprises an arched or rather curved design. Said convexly curved design when seen from the side is important, as mentioned above, for the option of actuation both with the thumb (from behind) and with the index finger (from the front) with the same hand. To illustrate said curvature, a circle K1 with a radius r1 is added in FIG. 1*b*, part of the circle K1 being described by part of the handle head top edge and consequently also of the bottom edge 19 of the actuating region 10. In the exemplary embodiment shown, the actuating region 10 also comprises a curved realization in a plane E2 which extends perpendicularly to the pole handle longitudinal axis S and through the direction of movement L and the rotational axis 11, which, however, cannot easily be seen in the figures. In addition, the pole handle 1 according to the invention comprises a hook-like device 4 which forms a component part of the handle body 3. It is realized by means of a slot 6 in the handle head 2 or rather in the top portion of the handle body 3. Said insertion slot 6 is suitable for receiving a strap-shaped, ring-shaped or eyelet-shaped device on a user hand-retaining device.

In the rear or rather hand-side handle head region 2*a*, the actuating region 10 comprises an extension 10*c* which engages over the insertion slot 6, this being accessible from the hand side H. In the exemplary embodiment shown, the extension 10*c* comprises a flank 17 which is beveled/angled upward at an angle a of approximately 105 degrees with respect to the pole longitudinal axis S, measured in a plane E1 which is spanned by the pole handle longitudinal axis S and the direction of movement L.

Figure 6A:
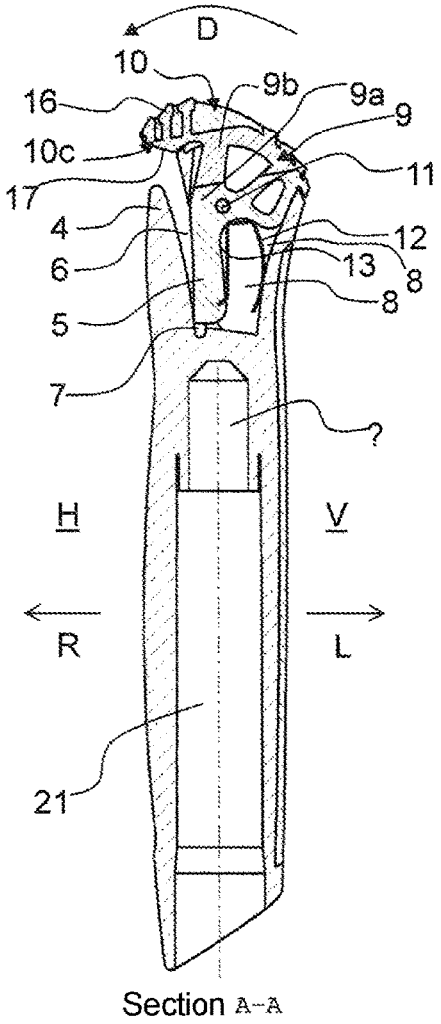
FIG. 6*a* showing a sectional representation of the pole handle of FIG. 1*a* and FIG. 6*b* showing analogously a sectional representation of the pole handle of FIG. 1*b* along the axis A-A, but in the release position.

FIG. 1*a* or rather the sectional representation in FIG. 6*a* shows the pole handle 1 in a rest position. This means that the latching means 5, i.e. the retaining lug or rather latching lug, is braced against the hook-like device 4 and either a strap-shaped, ring-shaped or eyelet-shaped device of the user hand-retaining device is held captive in a restricted region 7, or that no hand-retaining device is coupled to the pole handle 1. The hand-retaining device can be inserted into the insertion slot 6 in the rest position and can be fixed in a self-locking manner on the pole handle 1 without actuating the actuating region 10.

Figure 1B:
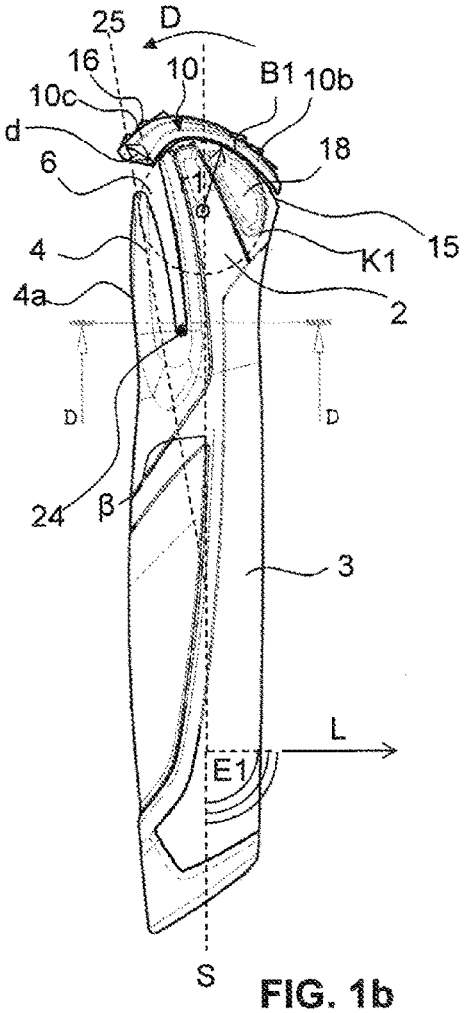
Figure 6B:
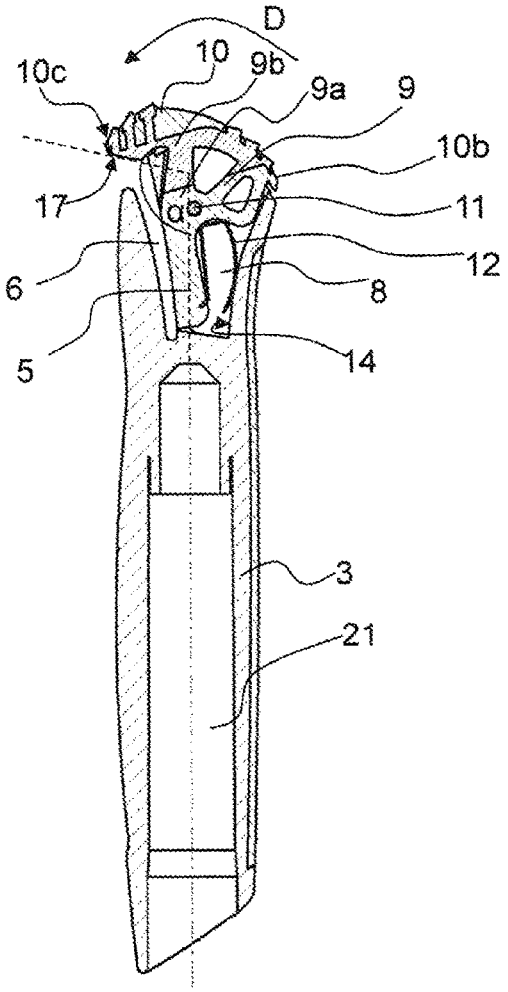
FIG. 6 shows two sectional representations of the handle of FIG. 1 along the axis A-A of FIG. 4.
Figure 7A:
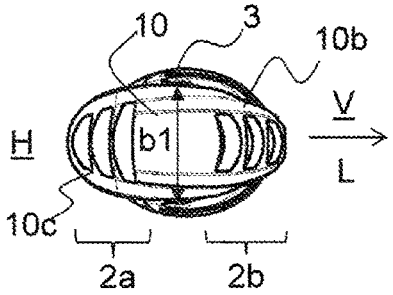
FIG. 7*a* showing the pole handle in a rest position and FIG. 7*b* showing the pole handle in a release position.
Figure 7B:
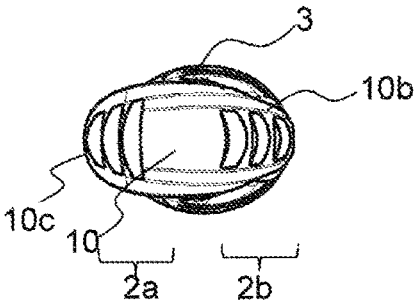
FIG. 7 shows a schematic view of the pole handle of FIG. 1 from above.
Figure 8:
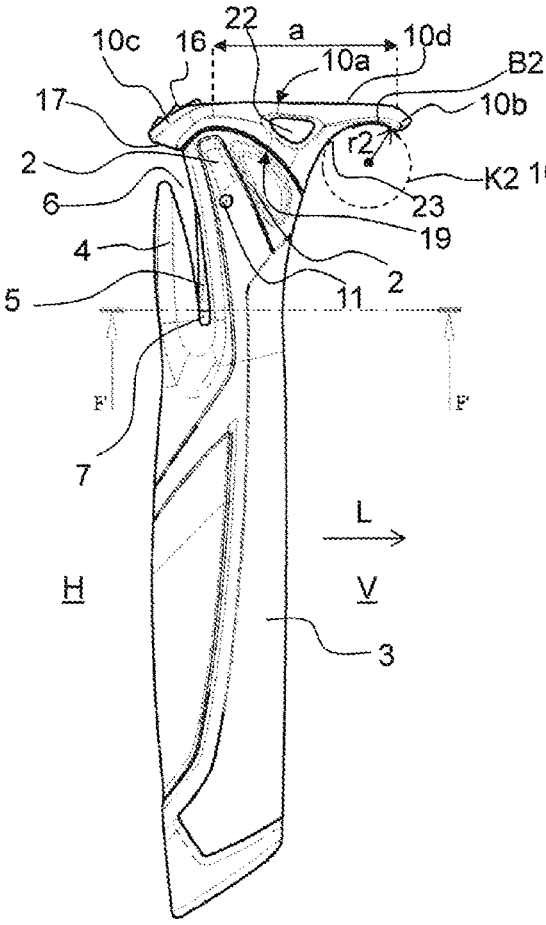
FIG. 8 shows a schematic representation of a side view of a pole handle according to a second preferred embodiment.
Figure 9:
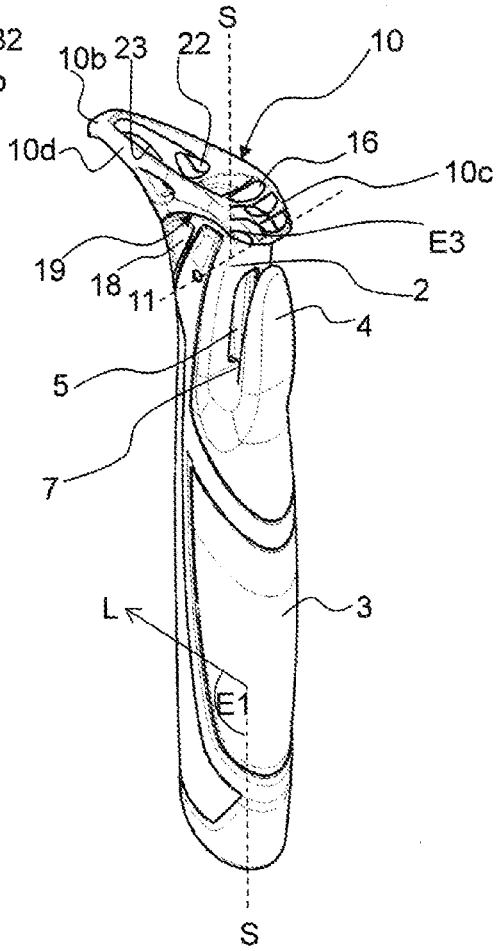
FIG. 9 shows a perspective schematic representation of the pole handle of FIG. 8.
Figure 10:
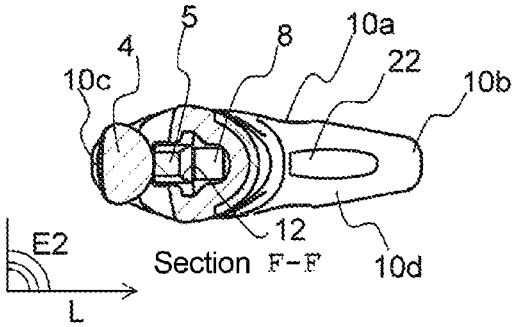
FIG. 10 shows a view from below of a sectional representation of the pole handle of FIG. 8 along the axis F-F in the rest position.
Figure 11:
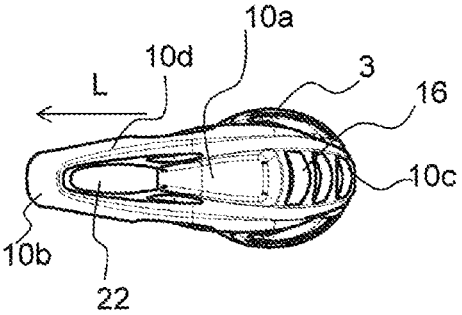
FIG. 11 shows a schematic view of the pole handle of FIG. 8 from above in the rest positon.
Figure 12:
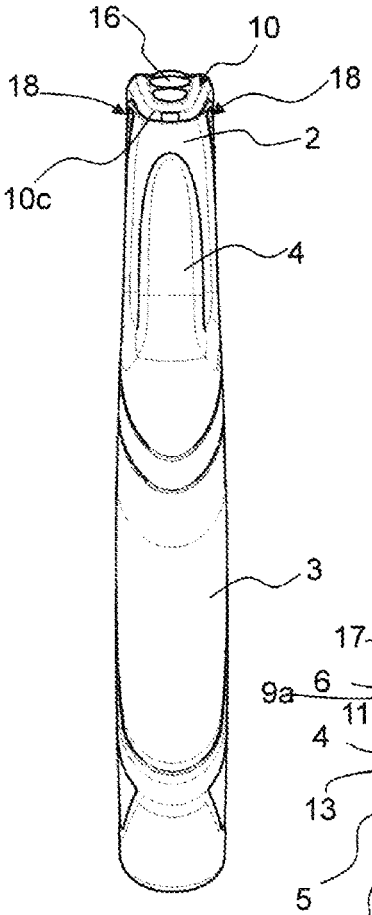
FIG. 12 shows a schematic representation of the pole handle of FIG. 8 when seen in a view from behind, i.e. from one hand side.
Figure 13:
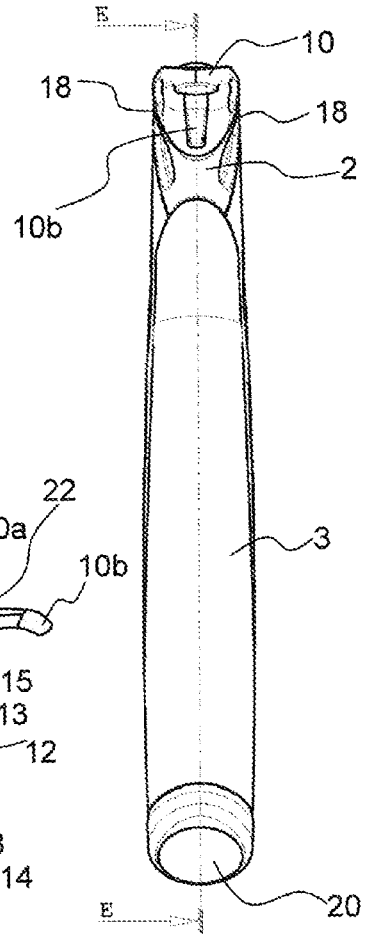
FIG. 13 shows a schematic representation of the pole handle of FIG. 8 when seen in a view from the front, i.e. from the direction of movement.
Figure 14:
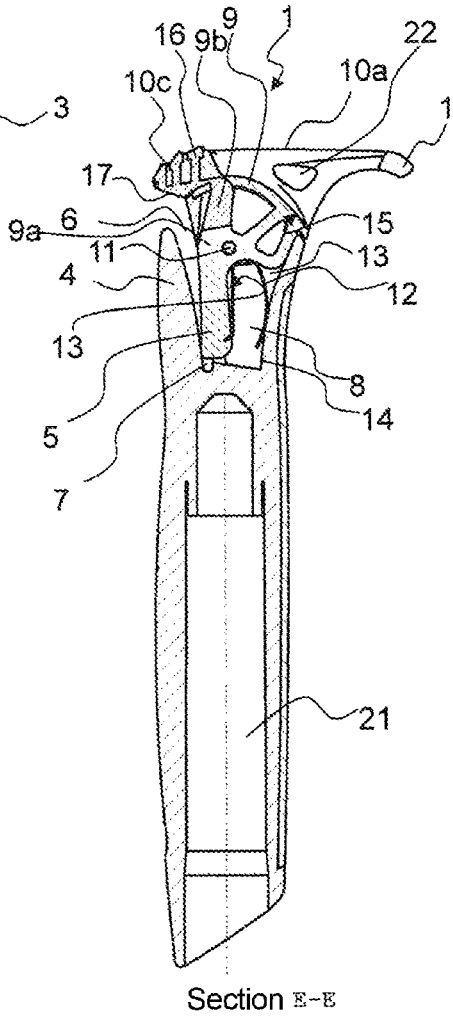
FIG. 14 shows a sectional representation of the pole handle from FIG. 8, along the axis E-E of FIG. 13.

FIG. 1*b* or the sectional representation in FIG. 6*b* shows the pole handle 1 in a release position. Compared to the rest position in FIG. 1*a*, the actuating region 10 is displaced or rather tilted rearward toward the hand side with its bottom edge 19 along the side walls 18 of the handle head. The extension 10*c* consequently overlaps the holding mandrel 4 more than in the rest position. In the front handle head region, in this case, the top edge of the downwardly beveled flank 15 of the handle head 2 emerges slightly as a result of the displacement, even in the release position the actuating region 10 still covering the handle head 2 in a substantially complete manner. Said release position only exists temporarily, i.e. only during the uncoupling of the hand-retaining device from the pole handle 1. This is achieved by the user actuating the actuating region 10 against the force of a spring 12, as a result of which the locking block 9 is tilted and the retaining lug 5 which is integrally formed on the locking block 9 is removed out of the insertion slot 6, or rather is pivoted out of the slot 6 into the recess 8 of the handle head. As a result, the latching means 5 releases the latching region, or rather the restricted or rather enclosed region 7 and the strap-shaped, ring-shaped or eyelet-shaped device which is latched in the restricted region 7 can be removed, or rather can be unlooped over the holding mandrel 4. A longitudinal section through the pole handle 1 of FIG. 1*a* is shown in FIG. 6*a*. The leaf spring 12, which is provided for bracing the locking block 9, is visibly represented there in a corresponding front recess 13 in the locking block 9. Said spring is loaded rearwardly or rather toward the hand side H against the retaining lug 5, and toward a front side V against the front inside wall 14 of the handle body 2 in the recess 8.

The extension 10*c* on the actuating region 10 and the path of the movement of the actuating region 10 for the release movement is provided or set up in such a manner that access to the insertion slot 6 is ensured both in the rest position and in the release position, at least in a direction from the back to the front, or rather parallel to the direction of movement L.

The actuating region 10 additionally comprises on its top surface, both in the rear handle head region 2*a* and in the front handle head region 2*b*, a structuring 16, or rather a ribbing, which provides the user with a grippier surface when releasing the latching mechanism. The structuring 16 is arranged at the back and at the front as the user is able to actuate the actuating region 10 in the direction of rotation D both with the thumb and with the index finger of the hand that is coupled to the pole handle 1 by means of a hand-retaining device (or with a finger of the other hand). It can be seen in FIGS. 6*a* and 6*b* that the structuring 16 is formed by extensions of a middle portion 9*b* of the locking block 9 which project through the actuating region 10. In the exemplary embodiment shown, the locking block 9 is realized with multiple parts, having a bottom portion 9*a* on which the locking block 9 is mounted in the handle head 2 by means of a transverse pin along the rotational axis 11, and which forms the retaining lug 5 and the recess 13 for receiving the leaf spring 12. The middle portion 9*b*, which connects to the bottom portion 9*a* at the top thereof, then forms, by means of extensions which serve as structuring, the connection between the bottom portion 9*a* and the actuating region 10, which, in turn, to a certain extent forms a top portion of the locking block 9. Said different portions 9*a*, 9*b*, 10, in this case, can be formed from the same or from different materials, wherein in case different materials are used, a softer material is suitable for the actuating region 10 which projects out of the handle head 2 than for the portions 9*a*, 9*b* of the locking block 9 which are sunk in the recess 8 of the handle head 2. The locking block 9, however, can also be realized in one piece, the actuating region 10 being realized either as the topmost portion of the locking block 9 or being integrally formed or fastened on the locking block.

Figure 2A:
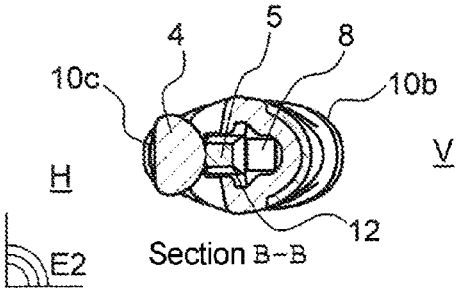
FIG. 2 shows a sectional representation of the pole handle from FIG. 1, FIG. 2*a* showing a view from below of a sectional representation along the axis B-B of FIG. 1*a* and FIG. 2*b* showing a view from below of a sectional representation along the axis D-D of FIG. 1*b;*
Figure 2B:
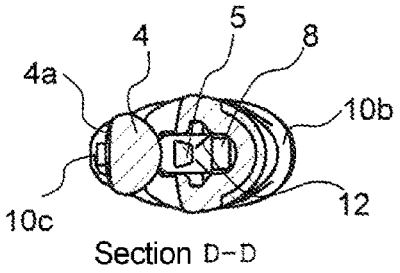
Figure 3:
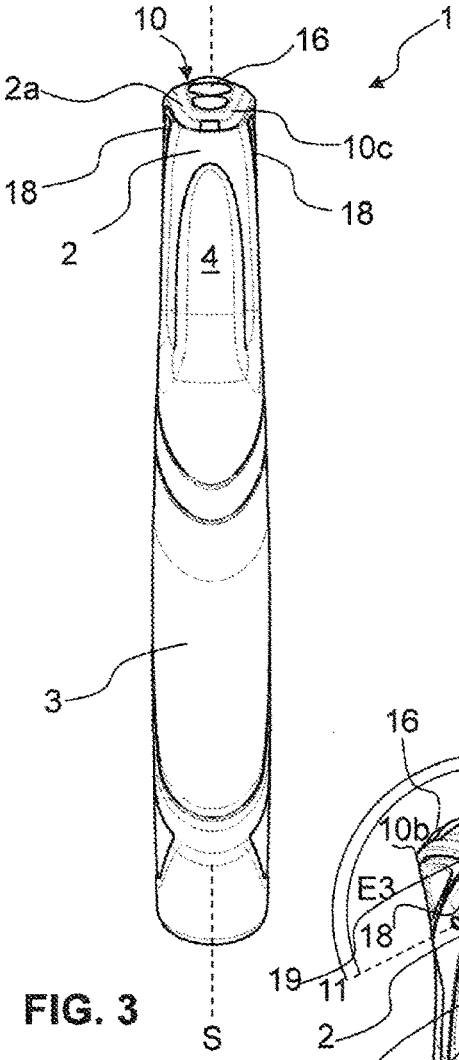
FIG. 3 shows a schematic representation of the pole handle of FIG. 1 when seen in a view from behind, i.e. from one hand side.
Figure 4:
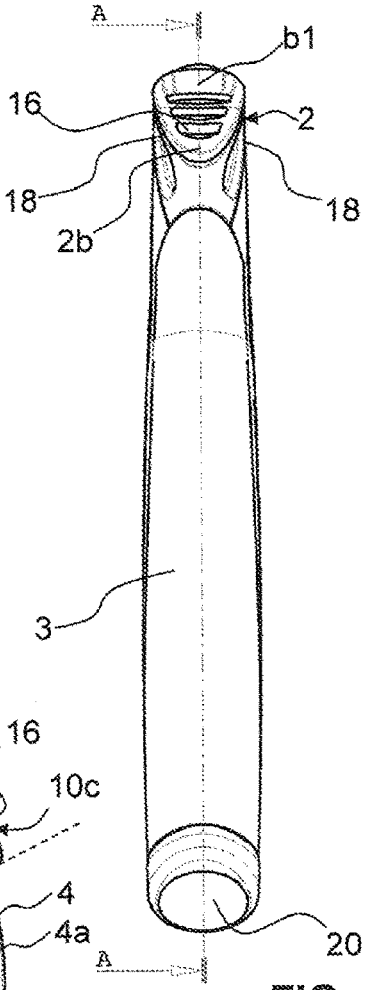
FIG. 4 shows a schematic representation of the pole handle of FIG. 1 when seen in a view from the front, i.e. from the direction of movement.
Figure 5:
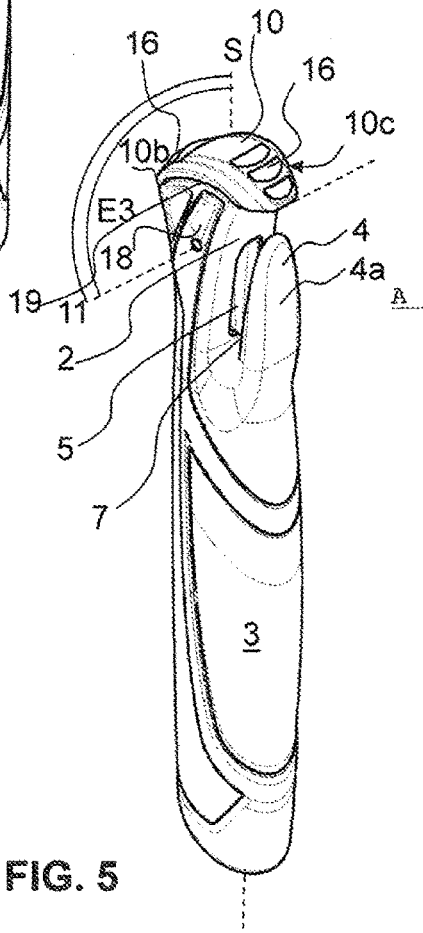
FIG. 5 shows a perspective schematic representation of the pole handle of FIG. 1.

As can be seen from FIG. 2*b*, the holding mandrel 4 comprises a flattening 4*b* on the side facing the hand side H, when viewed in cross section. Consequently, the holding mandrel is to a certain extent D-shaped, the straight region facing the hand side. Said design of the cross-sectional form of the holding mandrel can be used for the purpose of avoiding or even entirely preventing a rotation of the strap or eyelet 24, which is shown schematically in FIGS. 1*a* and *b* at the bottom end of the slot (once caught in the restricted region 7 in FIG. 1*a*, and once not caught and to a certain extent prepared to be guided out of the slot in FIG. 1*b*). This is as a result of said strap or eyelet also being realized to a certain extent in a D-shaped manner and thus the two straight regions being able to move to abut against one another and prevent rotation. Such a design of the strap or rather eyelet on the hand-holding device can be realized in a simple manner by the fastening region of the strap or rather eyelet being realized in a rigid and flat manner, which can be ensured, for example, possibly even just on account of the fastening, but can also be supported by additional plastics material elements or strips.

As mentioned in the introduction, the axis 25 of the holding mandrel 4 can be arranged parallel to the pole handle longitudinal axis S. As shown in FIG. 1*b*, and this is the preferred design for certain applications, the axis 25 of the holding mandrel 4 can also be realized, however, in a slightly rearwardly inclined manner, at an angle β which extends in a positive manner anti-clockwise in the representation according to FIG. 1*b*. Said slight rearward inclination, which is typically within the range of approximately 10°, leads to better introduction of force in particular when used in sport.

FIGS. 8-14 show a second preferred exemplary embodiment of the present invention. Said pole handle 1, which is particularly suitable, among other things, for the biathlon sport, is realized as regards the latching mechanism in an identical manner to the pole handle previously described and shown in FIGS. 1-7*b*. Correspondingly, the same references have been chosen for the same elements. The second exemplary embodiment differs from the first substantially only in the design of the actuating region 10. In the second preferred exemplary embodiment of FIGS. 8-14, in addition to the extension 10*c* in the rear handle head region 2*a*, the actuating region 10 additionally comprises an extension 10*d* in the front handle head region 2*b*. The actuating region 10 is realized on its top surface by a straight portion 10*a*, which connects to the rear extension 10*c* in the direction of movement L and comprises a length a within the range of between 1.5 and 3.5 cm, in particular in a preferred manner between 2 and 3 cm, and terminates in a downwardly curved front end 10*b*. The protrusion beyond the handle head 2, in this case, is between 1 and 2.5 cm. The bottom edge 23 of the front extension 10*d* comprises an arched portion of a circle K2 with a radius r2 in the front handle head region 2*b*, also in part on the bottom surface of the portion 10*a* that is straight on the top surface, the circle circumference of the circle K2 corresponding at least to the circumference of an index finger of a user hand. The front extension 10*d* consequently serves as a "stop catch" for the index finger of a user hand which has engaged the pole handle in just a loose manner and allows it then to slip downward down though the inside surface of the hand until the index finger finds a stop on the stop catch and consequently the hand has reached the correct position for coupling the hand-retaining device on the pole handle. Consequently, the user is able to latch-in the strap-shaped, ring-shaped or eyelet-shaped device to a certain extent in a "blind" manner. In addition, the user, when his index finger comes to rest on the bottom edge 23 of the extension 10*d*, is able to actuate the release mechanism upward as a result of exerting pressure in the axial direction, and not only with the thumb as a result of a rotational movement of the actuating region 10 on the top surface thereof. In addition, the front extension 10*d* comprises material cutouts or recesses 22 on its sides and on the top surface.

LIST OF REFERENCES

| | |
|---|---|
| 1 | Pole handle |
| 2 | Handle head |
| 2a | Hand-side, rear handle head region |
| 2b | Front handle head region |
| 3 | Handle body |
| 4 | Hook-like device, holding mandrel |
| 4a | Flattening on the holding mandrel |
| 5 | Latching means, retaining lug |
| 6 | Insertion slot |
| 7 | Restricted region |
| 8 | Recess in 2 |
| 9 | Locking block |
| 9a | Bottom portion of 9 |
| 9b | middle portion of 9 |
| 10 | Actuating region, top portion of 9 |
| 10a | Straight portion of 10 |
| 10b | Front end of 10 |
| 10c | Rear extension of 10 |
| 10d | Front extension of 10 |
| 11 | Rotational axis of 9 |
| 12 | Spring, leaf spring |
| 13 | Recess at 9 or 9a |
| 14 | Front inside wall of 2 |
| 15 | Flank of 2 |
| 16 | Structuring at 10 |
| 17 | Flank of 10c |
| 18 | Side wall of 2 |
| 19 | Bottom edge of 10 |
| 20 | Insertion opening in 3 for pole tube |
| 21 | Recess in 3 for pole tube |
| 22 | Material cutout in 10 |
| 23 | Bottom edge of 10d |
| 24 | Strap/eyelet |
| 25 | Axis of 4 |
| a | Length of 10a |
| α | Angle of 17 |
| β | Angle between S and 25 |
| b1 | Width of 10 at widest point |
| d | Thickness of 10c |
| B1 | Arc of K1 about 11 |
| B2 | Arc of K2 at 23 |
| D | Release movement |
| E1 | Plane through S and L |
| E2 | Plane perpendicular to S, through L and 11 |
| E3 | Plane through S and 11 |
| H | Rear side, hand side |
| K1 | Circle about 11 |
| K2 | Circle defined by 10b |
| L | Direction of movement |
| r1 | Circle radius about 11 |
| r2 | Circle radius |
| R | Opposite the direction of movement |
| S | Pole handle longitudinal axis |
| V | Front side |

The invention claimed is:

1. A pole handle for poles, that is attachable to a hand-retaining device, in the form of a hand strap or a glove having thereon a strap-shaped, ring-shaped or eyelet-shaped device, the pole handle comprising:

a handle head, a handle body, and a hooking device for fastening to the hand-retaining device, wherein a displaceable, pivotable or rotatable latching means is arranged in a region of the hooking device in such a manner that the strap-shaped, ring-shaped or eyelet-shaped device of the hand-retaining device, which is inserted substantially from above into the hooking device, is fixed in a self-locking manner by the latching means in the hooking device, wherein the hooking device is arranged on the pole handle on a hand side in a top region or in the handle head, wherein the hooking device includes a holding mandrel or holding pin which is arranged offset to the hand side from the handle body, thereby forming an insertion slot or arranged as an incision in the handle body, wherein the latching means is a retaining lug which, in a braced position defines in a downward direction, with the holding mandrel or holding pin, a restricted region for the strap-shaped, ring-shaped or eyelet-shaped device, wherein a recess is provided from above in the handle head and/or handle body, in which recess a displaceably and/or rotatably mounted locking block is arranged, on or in which the latching means is arranged, wherein on its upper side, the locking block comprises an actuating region which forms the handle head at least in part and which, on the hand side, in a rear handle head region, engages over a top of the insertion slot at least in part without closing access to the insertion slot, wherein the actuating region, in the rear handle head region, on the hand side, comprises an extension which extends substantially transversely to the pole handle longitudinal axis along a horizontal direction and which engages over the insertion slot at least in part, and wherein the insertion slot is engaged over at least in part by the extension of the actuating region both in the braced position, in which the latching means is braced against the hooking device, and in a release position in which the latching means releases the insertion slot.

2. The pole handle as claimed in claim 1, wherein the actuating region forms an upper closure of the handle head, wherein the actuating region engages over a top of a side wall, or a top of both lateral side walls, of the handle head.

3. The pole handle as claimed in claim 1, wherein the extension comprises on its hand-side end an upwardly beveled flank which extends upward forming an angle of between 95 and 120 degrees to a plane which is spanned by the pole handle longitudinal axis and rotational axis.

4. The pole handle as claimed in claim 1, wherein the actuating region at its widest point comprises an almost identically large or an at least identically large or larger width than a width of the handle head at its widest point.

5. The pole handle as claimed in claim 1, wherein the actuating region extends further in the front handle head region in the direction of movement than the handle head in the front handle head region.

6. The pole handle as claimed in claim 1, wherein the locking block is mounted on the handle head so as to be rotatable about a horizontal rotational axis which is arranged perpendicularly to the pole handle longitudinal axis.

7. The pole handle as claimed in claim 6, wherein a bottom edge of the actuating region which adjoins a side wall of the handle head, and also the side wall at that location, forms at least in regions an arc about the rotational axis of the locking block, defining a circle with a circle radius of between 0.5 and 3.5 cm or between 0.5 and 1.8 cm.

8. The pole handle as claimed in claim 1, wherein the locking block is realized in one piece with the actuating region or wherein the actuating region is integrally formed on the locking block.

9. The pole handle as claimed in claim 1, wherein the actuating region is realized in a convex manner in relation to a plane which is spanned by the pole handle longitudinal axis and the direction of movement, and can also be realized in a convex manner in relation to a plane which extends perpendicularly to the pole handle longitudinal axis.

10. The pole handle as claimed in claim 1, wherein on its upper side, the actuating region comprises a structuring, including a ribbing, which is suitable for preventing a user finger from slipping, wherein the structuring can be arranged both in a rear hand-side handle head region as well as in a front handle head region.

11. The pole handle as claimed in claim 1, wherein the actuating region is realized in a downwardly arched manner in the front handle head region and can also be realized in an arched manner in the hand-side rear handle head region.

12. The pole handle as claimed in claim 1, wherein the actuating region is realized in a converging manner in the direction of movement in the front handle head region and/or in the hand-side rear handle head region.

13. The pole handle as claimed in claim 1, wherein in the front handle head region, the actuating region comprises an extension which overlaps the handle head in the direction of movement, wherein it overlaps by between 1 and 3.5 cm, or by between 1.5 and 2.8 cm.

14. The pole handle as claimed in claim 1, wherein in a front handle head region, the actuating region comprises a substantially straight portion which extends in the direction of movement substantially horizontally to the pole handle longitudinal axis, over a length of between 1.0 and 3.5 cm, or between 1.5 and 3.5 cm, or between 2 and 3 cm, and, in the front handle head region, the actuating region comprises an end, which connects to the straight portion and is bent downward.

15. The pole handle as claimed in claim 1, wherein the locking means is realized in the form of a retaining lug, which can be arranged on or in the locking block or is realized in one piece with the locking block and, in a position braced against the hooking device, defines downward a restricted region for the strap-shaped, ring-shaped or eyelet-shaped device.

16. The pole handle as claimed in claim 1, wherein the locking block is braced by means of a spring, or by means of a leaf spring, against the hooking device which is arranged on the hand side, wherein the spring can be arranged in a recess of the locking block, wherein the recess can be arranged in a front region of the locking block, said front region being directed away from the hooking device in the direction of movement, and wherein the spring can be braced against an inside wall of the handle head in the recess of the handle head.

17. The pole handle as claimed in claim 16, wherein the locking block is tiltable against the force of the spring about the rotational axis from the outside by means of the actuating region, thereby releasing the self-locking.

18. A combination comprising a pole that is attachable to a hand-retaining device, in the form of a hand strap or a glove having thereon a strap-shaped, ring-shaped or eyelet-shaped device having a pole handle as claimed in claim 1.

19. The pole handle as claimed in claim 1, wherein the extension comprises on its hand-side end an upwardly beveled flank which extends upward forming an angle of between 100 and 105 degrees, to a plane which is spanned by the pole handle longitudinal axis and the rotational axis.

20. The pole handle as claimed in claim 1, wherein the actuating region forms an upper closure of the handle head, wherein the actuating region engages over a top of a side wall, or a top of both lateral side walls, of the handle head, and covers a downwardly beveled flank of the handle head in a front handle head region.

21. The pole handle as claimed in claim 1, wherein the actuating region at its widest point comprises an almost identically large or an at least identically large or larger width than a width of the handle head at its widest point, wherein the actuating region at its widest point comprises a width of between 0.7 and 2.5 cm, or of between 1 and 2 cm.

22. The pole handle as claimed in claim 1, wherein the locking block is mounted on the handle head so as to be rotatable about a horizontal rotational axis which is arranged perpendicularly to the pole handle longitudinal axis and transversely to the direction of movement.

* * * * *